US006468063B1

(12) United States Patent
Kobayashi et al.

(10) Patent No.: US 6,468,063 B1
(45) Date of Patent: Oct. 22, 2002

(54) COLD DRAWING APPARATUS

(75) Inventors: Toshio Kobayashi, Kagawa-ken (JP); Masaki Yoshida, Kagawa-ken (JP)

(73) Assignee: Uni-Charm Corporation, Ehime-Ken (JP)

( * ) Notice: Subject to any disclaimer, the term of this patent is extended or adjusted under 35 U.S.C. 154(b) by 110 days.

(21) Appl. No.: 09/617,091

(22) Filed: Jul. 14, 2000

(30) Foreign Application Priority Data

Jul. 15, 1999 (JP) ..... 11-201501

(51) Int. Cl.[7] ..... D01D 5/12

(52) U.S. Cl. ..... 425/66; 425/72.2; 425/83.1; 425/387.1

(58) Field of Search ..... 425/66, 72.2, 81.1, 425/83.1, 387.1

(56) References Cited

U.S. PATENT DOCUMENTS 3,554,854 A 1/1971 Hartmann
4,064,605 A * 12/1977 Akiyama et al. ..... 425/66
4,692,106 A * 9/1987 Grabowski et al. ..... 425/66
5,460,500 A * 10/1995 Geus et al. ..... 425/72.2
5,714,171 A * 2/1998 Profe ..... 425/66
5,853,628 A 12/1998 Varona ..... 264/6

FOREIGN PATENT DOCUMENTS

FR 1402829 5/1965
JP 1995-109658 4/1995

* cited by examiner

*Primary Examiner*—Jan H. Silbaugh
*Assistant Examiner*—Joseph Leyson
(74) *Attorney, Agent, or Firm*—Lowe Hauptman Gilman & Berner, LLP

(57) ABSTRACT

A cold drawing apparatus is interposed in a system for making a fibrous web and has an inlet for a plurality of melt spun continuous filaments, an outlet for the filaments and a pair of side walls extending between said in- and outlets and opposed to and spaced from each other in a transverse direction to define a passage therebetween so that the filaments are cooled and drawn as the filaments pass through the passage defined between the opposed side walls wherein at least one of the side walls is formed with a plurality of crests at predetermined intervals and a plurality of troughs each extending between each pair of the adjacent crests.

9 Claims, 3 Drawing Sheets

COLD DRAWING APPARATUS

BACKGROUND OF THE INVENTION

This invention relates to a cold drawing apparatus adapted to, in a process for making a fibrous web, cool and draw a plurality of melt spun filaments.

Japanese Patent Application Disclosure No. 1995-109658 describes a process for making a patterned fibrous web comprising a spinning step of discharging a plurality of continuous filaments from a spinning nozzle extending transversely of an apparatus onto a collecting conveyor travelling below the spinning nozzle to form the patterned fibrous web on the conveyor. An apparatus for static filamentation participates in the spinning step.

The apparatus for static filamentation is adapted to charge the filaments with static electricity so that these charged filaments may be spaced one from another under a repulsion generated among them. The filaments may be charged with electricity over a desired width, for a desired period and at a desired voltage in accordance with a predetermined program to provide the fibrous web with a predetermined pattern.

The process described in the Japanese Patent Application Disclosure No. 1995-109658 requires the apparatus for static filamentation adapted to a command from a programmed computer and thereupon to apply the filaments with voltage. Use of such apparatus for static filamentation correspondingly increases a manufacturing cost of the fibrous web.

SUMMARY OF THE INVENTION

This invention aims to provide a cold drawing apparatus requiring no apparatus for static filamentation to charge the filaments with static electricity and thereby enabling a patterned fibrous web to be made at a relatively low cost.

According to this invention, there is provided a cold drawing apparatus interposed in a system for making a fibrous web and having an inlet for a plurality of melt spun continuous filaments, an outlet for the filaments and a pair of side walls extending between the in- and outlets and opposed to and spaced from each other in a transverse direction orthogonal to a direction in which the filaments are fed to define a passage therebetween so that the filaments are cooled and drawn as the filaments pass through the passage defined between the opposed side walls, wherein: at least one of the opposed the walls is formed with a plurality of crests extending in the transverse direction at predetermined intervals and a plurality of troughs each extending between each pair of adjacent the crests.

In one preferred embodiment of this invention, the crests are formed on both of the side walls at regular intervals in the transverse direction so that the crests on one of the side walls are respectively opposed to the crests on the other side walls and wherein the troughs are formed on both of the side walls at regular intervals in the transverse direction so that the troughs respectively extend in fan shapes and the troughs on one of the side walls are respectively opposed to the troughs on the other side wall.

In another embodiment of this invention, a value corresponding to the minimum dimension of the passage defined between each pair of the opposed crests divided by the minimum dimension of the passage defined between each pair of the opposed troughs is in a range of 0.1~0.7.

In still another embodiment of this invention, a dimension of the crest as measured in the transverse direction is in a range of 10–100 mm and a dimension of the trough as measured in the transverse direction is in a range of 10~100 mm.

In further another embodiment of this invention, at least one of the side walls is formed with an air supply opening lying between the inlet and a region having the crests and troughs to supply compressed air toward the outlet.

In further additional embodiment of this invention, the apparatus is adapted to be oscillated in the transverse direction.

DETAILED DESCRIPTION OF THE PREFERRED EMBODIMENTS

Details of a cold drawing apparatus according to this invention will be more fully understood from the description given hereunder with reference to the accompanying drawings.

Figure 1:
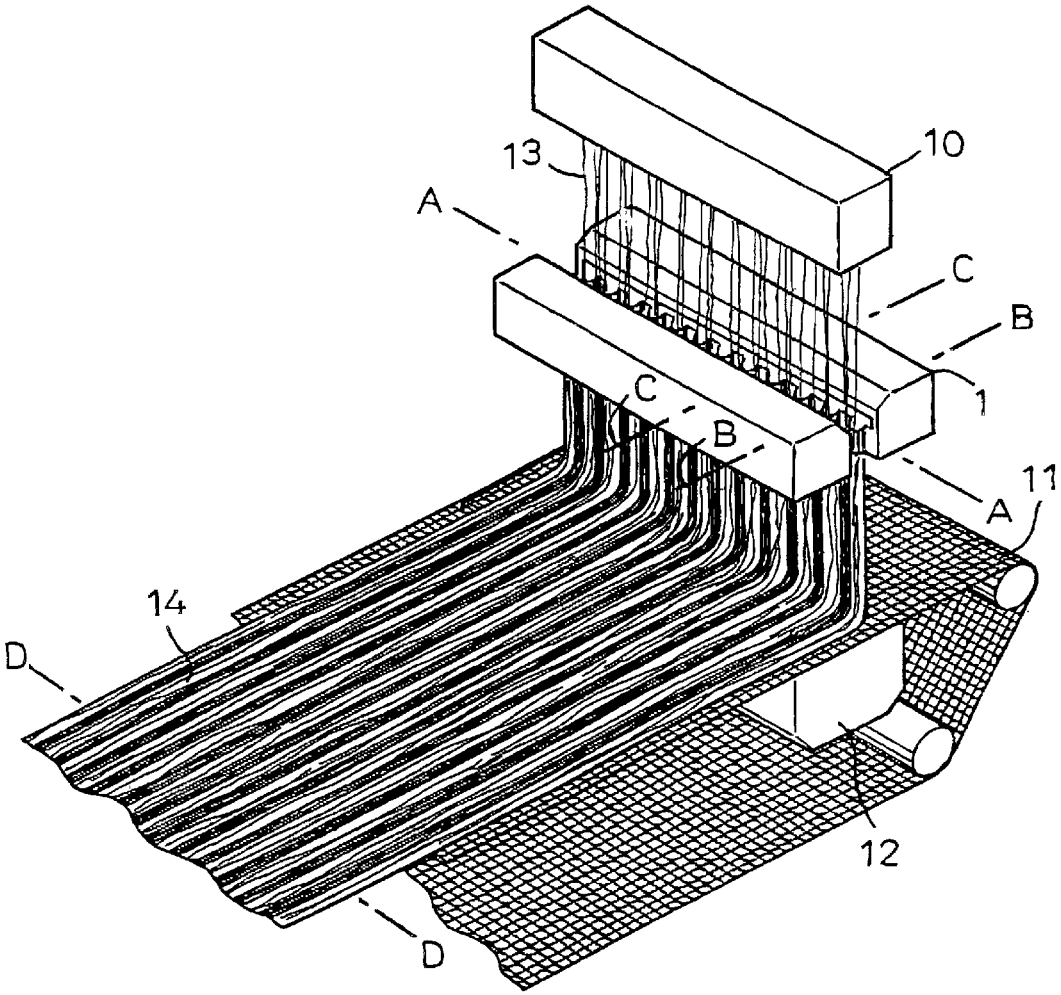
FIG. 1 is a perspective diagram illustrating a system for making fibrous web including a perspective view of an apparatus according to this invention.

FIG. 1 is a perspective diagram illustrating a system for making a fibrous web 14 including a perspective view of a cold drawing apparatus 1 according to this invention in which the fibrous web 14 and a conveyor 11 are partially eliminated. The system includes a spinning nozzle 10 adapted to discharge a plurality of continuous filaments 13, a cold drawing apparatus 1 adapted to cool and draw the melt spun filaments 13, a netlike collecting conveyor 11 adapted to collect the filaments 13 thus cooled and drawn, and an air suction mechanism 12 lying below the conveyor 11 to establish an air stream sucked from an upper side toward a lower side of the conveyor 11. The nozzle 10, the apparatus 1 and the conveyor 11 are spaced one from another by predetermined distances. The nozzle 10 discharges a plurality of filaments 13 at a substantially constant rate and with a substantially uniform basis weight.

The filaments 13 discharged from the nozzle 10 pass through the apparatus 1 in which the filaments 13 are cooled and at the same time drawn before these filaments 13 leave the apparatus 1. The filaments 13 having left the apparatus 1 are collected on the conveyor 11 to form fibrous web 14 on the conveyor 11. Though not shown, the filaments 13 are intertwined one with another by ejecting high pressure water streams to the fibrous web 14 on the conveyor 11 or by punching the fibrous web 14 with needles having barbs, or the filaments 13 are heat-bonded one with another by subjecting the fibrous web 14 to hot blast or the filaments 13 are bonded one to another by means of adhesive to form a desired nonwoven fabric.

Figure 2:
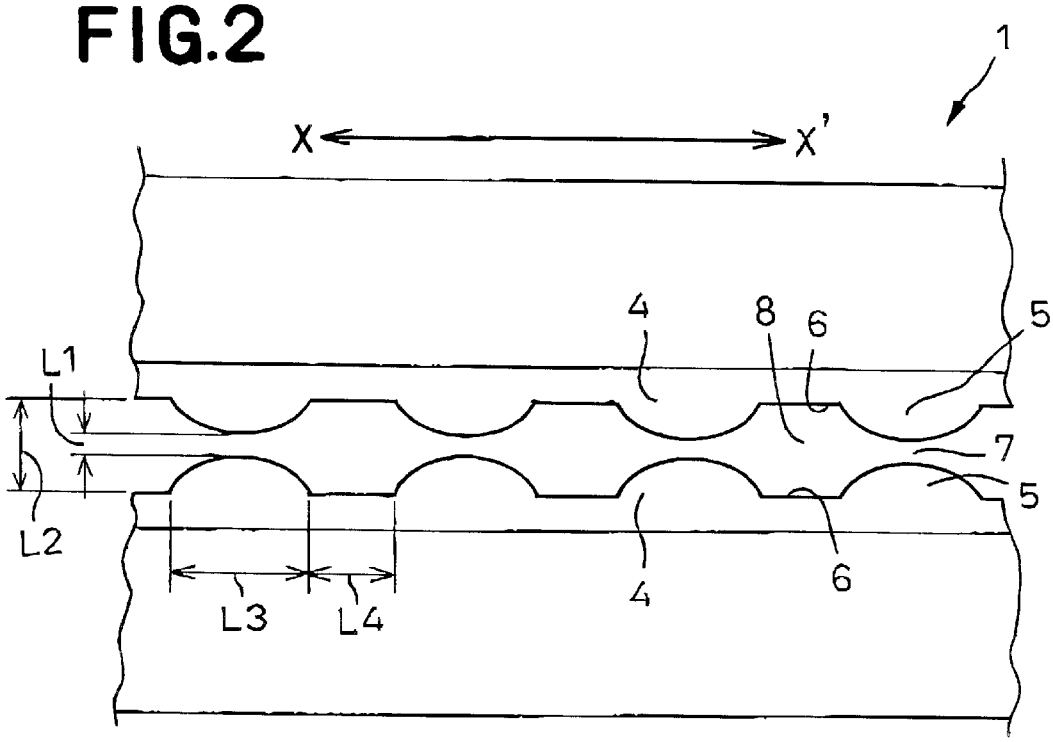
FIG. 2 is a sectional view of the apparatus taken along line A—A in FIG. 1 partially eliminated.
Figure 3:
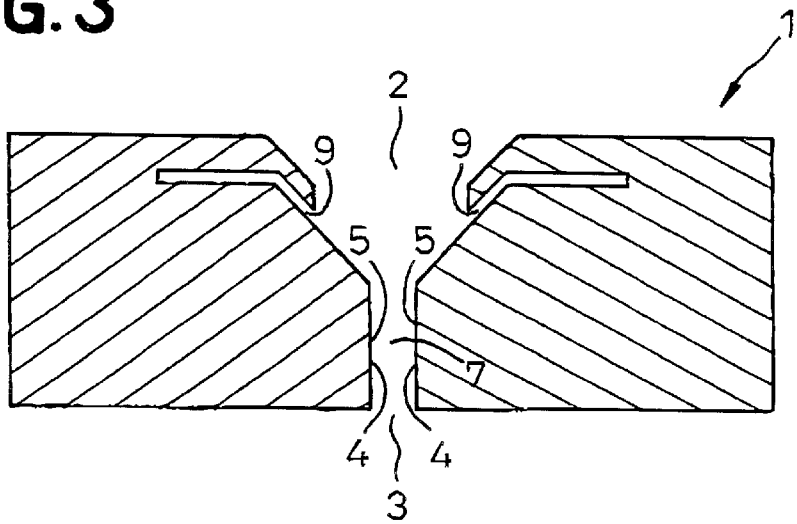
FIG. 3 is a sectional view of the apparatus taken along line B—B in FIG. 1.
Figure 4:
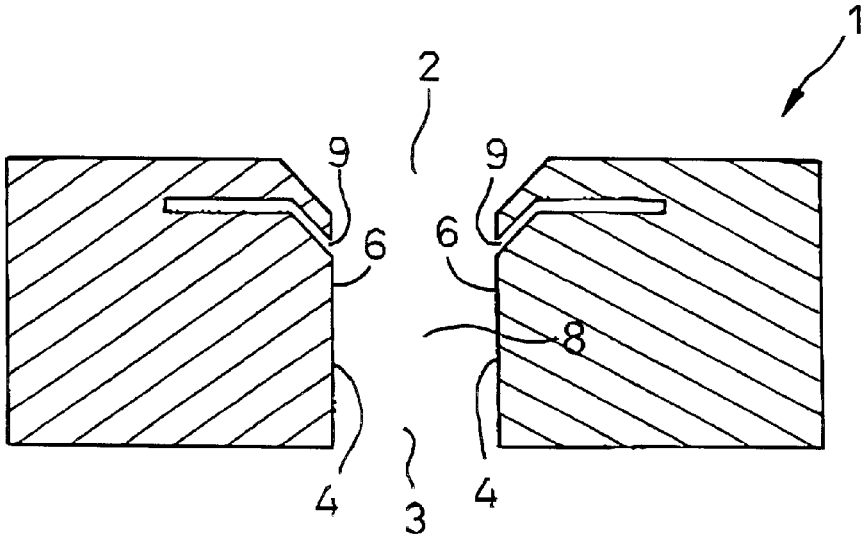
FIG. 4 is a sectional view of the apparatus taken along line C—C in FIG. 1.

FIG. 2 is a sectional view of the apparatus taken along a line A—A in FIG. 1 as partially eliminated and FIGS. 3 and 4 are sectional views of the apparatus taken along lines B—B and C—C in FIG. 1, respectively. In FIGS. 2, 3 and 4, illustration of the filaments 13 is eliminated. The apparatus 1 has an inlet 2 for the filaments 13, an outlet 3 for the filaments 13, side walls 4 extending between the inlet 2 and the outlet 3 transversely of the direction in which the filaments 13 are discharged and opposed to each other, and an air supply opening 9 provided in the vicinity of the inlet 2 to supply compressed air toward the outlet 3.

The side walls 4 of the apparatus 1 define therebetween passages or channels 7, 8 for the filaments 13. The apparatus 1 cools the filaments 13 by air stream supplied from the air supply opening 9 into the passages 7, 8 and simultaneously stretches the filaments 13 as these filaments 13 pass through the passage 7, 8.

Each of the side walls 4 of the apparatus 1 is formed with a plurality of crests 5 extending at regular intervals transversely of the direction in which the filaments 13 are fed and a plurality of troughs 6 extending at regular intervals also transversely of the aforesaid direction. The crests 5 on one of the side walls 4 are opposed to the crests 5 on the other side wall 4 and the troughs 6 on one of the side walls 4 are opposed to the troughs 6 on the other side wall 4. Each of the crests 5 is shaped in a semispherical projection having a cross-section describing a circular arc which is convex inwardly of the passage 7. Each of the troughs 6 extending in a tan shape between each pair of the adjacent crests 5. The crests 5 are round and therefore free from generation of a turbulence in the air stream flowing through the passages 7. Accordingly, the crests 5 are effective to prevent a stream of the filaments 13 from being disturbed.

The minimum dimension L1 of the passage 7 defined between each pair of opposed crests 5 is smaller than the minimum dimension L2 of the passage 8 defined between each pair of opposed troughs 6. An air pressure alternately rises and drops as air supplied from the supply opening 9 passes through the passages 7 defined between the respectively opposed crests 5 and the passages 8 defined between the respectively opposed troughs 6. Specifically, the air pressure rises in the passages 7 defined between the respectively opposed crests 5 due to a pressure drag by the crests 5 and drops in the passages 8 defined between the respectively opposed troughs 6. A velocity of the air flow decreases in the passages 7 defined between the respectively opposed crests 5 in which the air pressure is relatively high and increases in the passages 8 defined between the respectively opposed troughs 6 in which the air pressure is relatively low.

The amount of the filaments 13 discharged from the nozzle 10 and passing through the passages 8 defined between the respectively opposed troughs 6 is larger than the amount of the filaments 13 passing through the passages 7 defined between the respectively opposed crests 5 since the velocity of air flow is higher in the passages 8 than in the passages 7. Because of such difference in the velocity of air flow, the filaments 13 are stretched at a higher stretch ratio as they pass through the passages 8 and the filaments 13 are stretched at a lower stretch ratio as they pass the passages 7. With a consequence, the filaments 13 passing through the passages 8 have a fineness smaller than the filaments 13 passing through the passages 7. Of the filaments 13 collected on the conveyor 11, those having passed through the passages 8 defined between the respective opposed troughs 6 present a density and a bulk higher than those having passed through the passages 7 defined between the respectively opposed crests 5. In this manner, the finished fibrous web 14 is obtained which is formed with a pattern comprising a plurality of stripes extending longitudinally of the fibrous web 14.

In the apparatus 1, a value corresponding to the minimum dimension L1 of the passage 7 defined between each pair of opposed crests 5 divided by the minimum dimension L2 of the passage 8 defined between each pair of opposed troughs 6 is preferably in a range of 0.1–0.7. The value less than 0.1 would lead to a problematic situation in which the dimension L1 of the passage 7 defined between each pair of opposed crests 5 is excessively smaller than the dimension L2 of the passage 8 defined between each pair of opposed troughs 6. In this situation, the filaments 13 would crowd in the passages 8 and the filaments 13 passing through the passages 7 defined between the respectively opposed crests 5 would have a correspondingly small basis weight. As a result, regions of unacceptably low density may be generated in the fibrous web 14. The value exceeding 0.7, on the other hand, would unacceptably reduce a difference in the dimensions L1, L2 of the passages 7, 8 and therefore correspondingly reduce a difference in the velocity of air flow in these passages 7, 8. Consequently, the finished fibrous web 14 as a whole would have a substantially uniform density and sometimes it would be impossible to form the fibrous web 14 with a desired pattern.

In the apparatus 1, each crest 5 has its transverse dimension L3 preferably of 10–100 mm and each trough 6 has its transverse dimension L4 preferably of 10–100 mm. These dimensions L3, L4 less than 10 mm would, depending on a flow rate and a flow velocity of air supplied, lead to a situation in which the number of both the crests 5 and the troughs 6 are excessively increased and they are arranged at excessively close intervals. As a result, air streams flowing these passages would be apt to interfere one with another and to generate a turbulence in the passages 7, 8 or a wake in the vicinity of the outlet 3. These factors would disturb the stream of the filaments 13 and make it impossible to form a distinct pattern on the fibrous web 14. The dimensions L3, L4 exceeding 100 mm, on the other hand, each pair of adjacent crests 5 as well as each pair of adjacent troughs 6 would be spaced from each other by a distance too large to form a finely striped pattern on the fibrous web 14.

If the dimension L3 of each crest 5 is smaller than 10 mm and the dimension L4 of each trough 6 is larger than 100 mm, the filaments 13 would crowd into the passages 8 defined between the respectively opposed troughs 6 and the filaments 13 passing through the passages 7 defined between the respectively opposed crests 5 would be of a correspondingly small basis weight. In a consequence, regions of excessively low density would be generated in the fibrous web 14. If the dimension L3 of each crest 5 exceeds 100 mm and the dimension L4 of each trough 6 is less than 10 mm, on the contrary, the filaments 13 passing through the passages 7 defined between the respectively opposed crests 5 would have a basis weight correspondingly increased so far as the amount of the filaments 13 discharged from the nozzle 10. The basis weight of the filaments 13 passing through the passages 7 would sometimes increase until a differential basis weight between the filaments 13 passing through the passages 7, 8 would substantially become zero and no distinct striped pattern would appear on the fibrous web 14.

It is possible without departing from the scope of this invention to oscillate the apparatus 1 transversely thereof, i.e., in a direction indicated by a double-headed arrow X–X' in FIG. 2 so that the fibrous web 14 may be formed with a pattern comprising a plurality of stripes extending in a zigzag direction. The apparatus 1 may be moved in any one of the directions indicated by the double-headed arrow X–X' to form a striped pattern extending obliquely to the longitudinal direction of the fibrous web 14.

Figure 5:
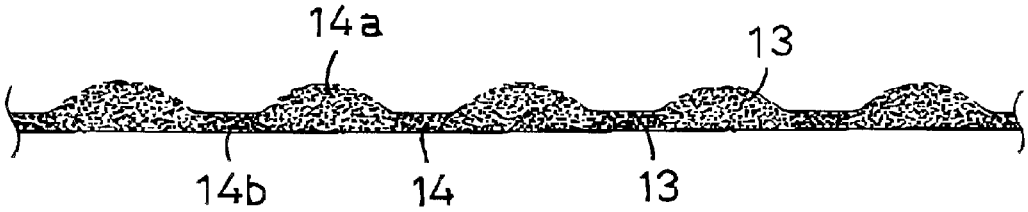
FIG. 5 is a sectional view of the fibrous web made by the apparatus taken along line D—D in FIG. 1.

FIG. 5 is a sectional view of the fibrous web 14 taken along a line D—D in FIG. 1. The fibrous web 14 has regions

14*a* in which the filaments 13 have relatively high density and bulk and regions 14*b* in which the filaments 13 have relatively low density and bulk. The regions 14*a* protrude upward with respect to the regions 14*b* and these regions 14*a*, 14*b* both extending longitudinally of the fibrous web 14 define a striped pattern on the fibrous web 14.

It is possible without departing from the scope of this invention to exploit the cold drawing apparatus 1 in a manner that, instead of providing the air supply opening 9, an air suction mechanism is provided below the apparatus 1 and thereby an air flow is generated. A temperature of air supplied may be at a room temperature or a temperature lower than the room temperature. Each of the crests 5 may be shaped so as to present not only the semicircular cross-section but also the other cross-sectional shape such as semi-ellipse, obelisk or triangle.

The filaments 13 may be of thermoplastic synthetic resin such as polyolefine, polyester or polyamide. It is also possible to use elastomer made of thermoplastic synthetic resin. Such elastomer includes those made of polyolefine, polyester, polyamide and polyurethane.

The cold drawing apparatus apparatus according to this invention enables the patterned fibrous web to be made at a low cost without using an apparatus for static filamentation adapted to charge the filaments with static electricity.

The dimensions of the passages defined between the respectively opposed crests and the passages between the respectively opposed troughs as well as the transverse dimensions of the crests and troughs may appropriately varied to obtain the fibrous web in which the filaments have a density and a bulk correspondingly varied. The fibrous web can be formed thereby optionally with a fine striped patter or a rough striped pattern.

What is claimed is:

1. A cold drawing apparatus for use in a system for making a fibrous web, said apparatus comprising:

an inlet for receiving a plurality of melt spun continuous filaments;

an outlet for discharging said filaments; and a pair of side walls disposed between said inlet and said outlet to be opposed to and spaced from each other, said side walls extending in a transverse direction orthogonal to a direction in which said filaments are fed to define a passage therebetween so that said filaments are cooled and drawn as said filaments pass through said passage;

wherein at least one of said opposed side walls is formed with a plurality of crests distributed in said transverse direction and a plurality of troughs each located between one pair of adjacent said crests.

2. The cold drawing apparatus according to claim 1, wherein said crests and troughs are formed on both of said side walls at regular intervals in said transverse direction so that said crests on one of said side walls are respectively opposed to said crests on the other side wall and said troughs on one of said side walls are respectively opposed to said troughs on the other side wall.

3. The cold drawing apparatus according to claim 2, wherein a ratio of the minimum dimension of said passage defined between each pair of the opposed crests divided by the minimum dimension of said passage defined between each pair of the opposed troughs is in a range of from about 0.1 to about 0.7.

4. The cold drawing apparatus according to claim 1, wherein a dimension of said crests as measured in said transverse direction is in a range of from about 10 to about 100 mm and a dimension of said troughs as measured in said transverse direction is in a range of from about 10 to about 100 mm.

5. The cold drawing apparatus according to claim 1, wherein at least one of said side walls is formed with an air supply opening lying between said inlet and a region having said crests and troughs to supply compressed air toward said outlet.

6. The cold drawing apparatus according to claim 1, wherein said apparatus is adapted to be oscillated in said transverse direction.

7. The apparatus of claim 2, wherein the opposed crests have a round shape to avoid generation of turbulence in an air stream flowing from the inlet through the passage, between said opposed crests, to the outlet.

8. A cold drawing apparatus for making a fibrous web, comprising:

an inlet for receiving a plurality of melt spun continuous filaments;

an outlet for discharging said filaments; and a pair of side walls disposed between said inlet and said outlet to be opposed to and spaced from each other to define therebetween a passage for said filaments;

wherein said passage comprises, along a transverse direction orthogonal to a drawing direction in which said filaments are drawn from the inlet to the outlet, a plurality of alternately arranged first and second sections, a distance between said side walls in said first sections being smaller than in said second sections, said first and second sections of the passages defining a plurality of alternately arranged first and second channels, respectively, extending in the drawing direction.

9. The apparatus of claim 8, further comprising an air flow generating device for generating an air flow in the drawing direction, said air flow having in said second channels a speed higher than in the first channels so that the filaments passing through said second channels are stretched at a ratio higher than the filaments passing through said first channels.

* * * * *